US005710572A

United States Patent [19]

Nihei

[11] Patent Number: 5,710,572

[45] Date of Patent: Jan. 20, 1998

[54] IMAGE DISPLAY APPARATUS AND METHOD

[75] Inventor: Kaname Nihei, Asaka, Japan

[73] Assignee: Fuji Photo Film, Co., Ltd., Kanagawa-ken, Japan

[21] Appl. No.: 418,375

[22] Filed: Apr. 7, 1995

[30] Foreign Application Priority Data

Apr. 8, 1994 [JP] Japan ..... 6-093896

[51] Int. Cl.[6] ..... G09G 5/00

[52] U.S. Cl. ..... 345/115; 345/126; 345/127

[58] Field of Search ..... 345/121, 126, 345/127, 128, 129, 130, 131, 115, 202; 348/581, 583, 333, 218, 232, 239; 358/906, 909.1, 403; 382/296, 297, 298

[56] References Cited

U.S. PATENT DOCUMENTS 5,270,831 12/1993 Pasulski et al. ..... 358/403

5,414,811 5/1995 Pasulski et al. ..... 382/296

*Primary Examiner*—Regina D. Liang

[57] ABSTRACT

When images of several frames captured by an image sensing device such as an electronic still-video camera are displayed on a display unit, the images are made easier to view by rotating each image in conformity with the inclination of the horizontal scanning direction of the camera, with respect to the horizontal, which prevailed when the image was captured. Several frames of compressed image data stored in a memory card or external storage unit are decompressed by a compression/expansion circuit and then stored in a compression/expansion memory. The stored compressed image data thus is read out by a thin-out/rotation circuit and the data is then thinned out, processed for movement to a designated position and processed for rotation based on angle data. The processed image data is stored in a display memory. Under the control of a display control circuit, the display unit displays the image data that has been stored in the display memory.

9 Claims, 9 Drawing Sheets

*Fig. 3*

ORIGINAL IMAGE DATA

| COORDINATES (x, y) | PIXEL DATA |
|---|---|
| (0, 0) | $d_0$ |
| (1, 0) | $d_1$ |
| (2, 0) | $d_2$ |
| (3, 0) | $d_3$ |
| (4, 0) | $d_4$ |
| ⋮ | ⋮ |
| (636, 0) | $d_{636}$ |
| ⋮ | ⋮ |
| (639, 0) | $d_{639}$ |
| (0, 1) | $d_{640}$ |
| (1, 1) | $d_{641}$ |
| ⋮ | ⋮ |
| ⋮ | ⋮ |
| (0, 4) | $d_{2560}$ |
| ⋮ | ⋮ |
| ⋮ | ⋮ |
| (0, 476) | $d_{304640}$ |
| ⋮ | ⋮ |
| (636, 476) | $d_{305276}$ |
| (637, 476) | $d_{305277}$ |
| ⋮ | ⋮ |
| (639, 479) | $d_{307200}$ |

THINNED-OUT IMAGE DATA

| COORDINATES (x, y) | PIXEL DATA |
|---|---|
| (0, 0) | $d_0$ |
| (1, 0) | $d_4$ |
| ⋮ | ⋮ |
| (159, 0) | $d_{636}$ |
| (0, 1) | $d_{2560}$ |
| ⋮ | ⋮ |
| ⋮ | ⋮ |
| (0, 119) | $d_{304640}$ |
| ⋮ | ⋮ |
| (159, 119) | $d_{305276}$ |

IMAGE DISPLAY APPARATUS AND METHOD

BACKGROUND OF THE INVENTION

1. Field of the Invention

This invention relates to an apparatus and method in which a plurality of frames of images obtained by image sensing are displayed in a form arrayed on a single display screen.

2. Description of the Related Art

When the image of a subject is captured by an image sensing device such as an electronic still-video camera, the operator may hold the horizontal scanning direction of the image sensing device horizontally or at an angle with respect to the horizontal (as by tilting a camera) to capture the image.

The conventional image display apparatus, which does not take into consideration the inclination of the horizontal scanning direction with respect to the horizontal at the time of imaging, presents a display of the sensed image on the assumption that the horizontal scanning direction is horizontal. Accordingly, a subject whose image has been captured in a state in which the horizontal scanning direction is inclined with respect to the horizontal is displayed on the display screen as an image tilted by an amount equivalent to this inclination. For example, if the image of a standing person is captured in a state in which the horizontal scanning direction of the image sensing device is held vertical to the horizontal, the image of the person will be displayed on the display screen on its side (i.e., horizontally). This means that an observer viewing this image must tilt his or her head or turn the displayed image inside his or her own head to reconstruct the image of the standing person. This makes observation a difficult task.

Furthermore, in a case where images of a plurality of frames captured at different inclinations of the horizontal scanning direction are displayed as an array on one display screen, the inclinations of the subjects captured will differ from image to image. This makes it necessary for the observer to change the angle of his or her head as each image is viewed. This also makes observation a difficult task.

SUMMARY OF THE INVENTION

Accordingly, an object of the present invention is to make it easy to view images of a plurality of frames displayed on a display unit by displaying each image upon rotating it on the basis of the inclination of the horizontal scanning direction, with respect to the horizontal, which prevailed when the image was captured.

According to the present invention, the foregoing object is attained by providing an image display apparatus comprising memory means for storing plural items of image data, which represent respective images of a plurality of frames captured by an image sensing device, in a form correlated with angle data representing an angle of inclination of the image sensing device which prevailed when each image was captured, display means for displaying the images of the plurality of frames, size reduction means for reducing each of the plural items of image data, rotating means for rotating the plural items of image data, which have been reduced by the size reduction means, on the basis of the angle data corresponding to this image data, and display control means for performing control so as to decide a display position, in the display means, of each of the plural items of image data rotated by the rotating means, and to display, at respective ones of the display positions decided, the images of the plurality of frames represented by the rotated plural items of image data.

Further, the foregoing object is attained by providing an image display method comprising the steps of storing plural items of image data, which represent respective images of a plurality of frames captured by an image sensing device, in a form correlated with angle data representing angle of inclination of the image sensing device which prevailed when each image was captured, reducing each of the plural items of image data, rotating the reduced plural items of image data on the basis of the angle data corresponding to this image data, deciding a display position, in a display unit, of each of the plural items of image data rotated, and displaying, at respective ones of the display positions decided, the images of the plurality of frames represented by the rotated plural items of image data.

The angle of inclination of the image sensing device is an angle which the horizontal scanning direction of the image sensing device (an electronic still-video camera or the like) forms with the horizontal. The angle data representing angle of inclination is measured by an angle measuring unit incorporated within the image sensing device. This angle data is stored in the memory means in correlation with the image data obtained by image sensing.

Examples of the memory means include a semiconductor memory, an optical memory, a magnetic disk storage device, an optical disk storage device, a memory card, an optical card, etc.

Examples of the display means include a CRT display unit, a liquid-crystal display device, etc.. The display means covers both a color display device and a monochromatic display device. A bitmap display device is especially preferred as the display means.

In order to display images of a plurality of frames on the display means, each of the plural items of image data is thinned out so as to be reduced in size. Each of the plural items of thinned-out image data is rotated on the basis of the angle data stored so as to correspond to this particular item of image data. A display position in the display means is decided for each of the plural items of image data, and an image is displayed at each display position decided.

In accordance with the present invention, it is possible to present a display which takes into account the inclination of the horizontal scanning direction prevailing at the time an image is captured, and the horizontal direction in the image displayed can be made to coincide with the horizontal direction of the display screen. As a result, the observer need not tilt his or her head to view each of a plurality of images. This makes viewing much easier.

The thin-out rate preferably is determined on the basis of the number of frames of images displayed on the display means. For example, in a case where four frames of image data, each of which fills the entire display screen when the image is displayed without being thinned out, are displayed on the display means, it is preferred that each of the four frames of image data be thinned out at such a thin-out rate that length in each of the horizontal and vertical directions be made less than half. This makes it possible to prevent the images from being displayed on the display screen in overlapping form.

Further, it is preferred that an identifier for identifying each item of image data is assigned beforehand to each of the plural items of image data, and that the identifiers assigned to the image data representing the images be displayed in correspondence with the respective ones of the displayed images of the plurality of frames. In a case where image data has been stored in the memory means as an image file, the file name of the image file can be used as the identifier. By displaying the identifier, the observer can readily determine which image of the plural frames of displayed images corresponds to a particular item of image data.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 3 illustrates an example of image-data thin-out processing;

DESCRIPTION OF THE PREFERRED EMBODIMENT

Figure 1:
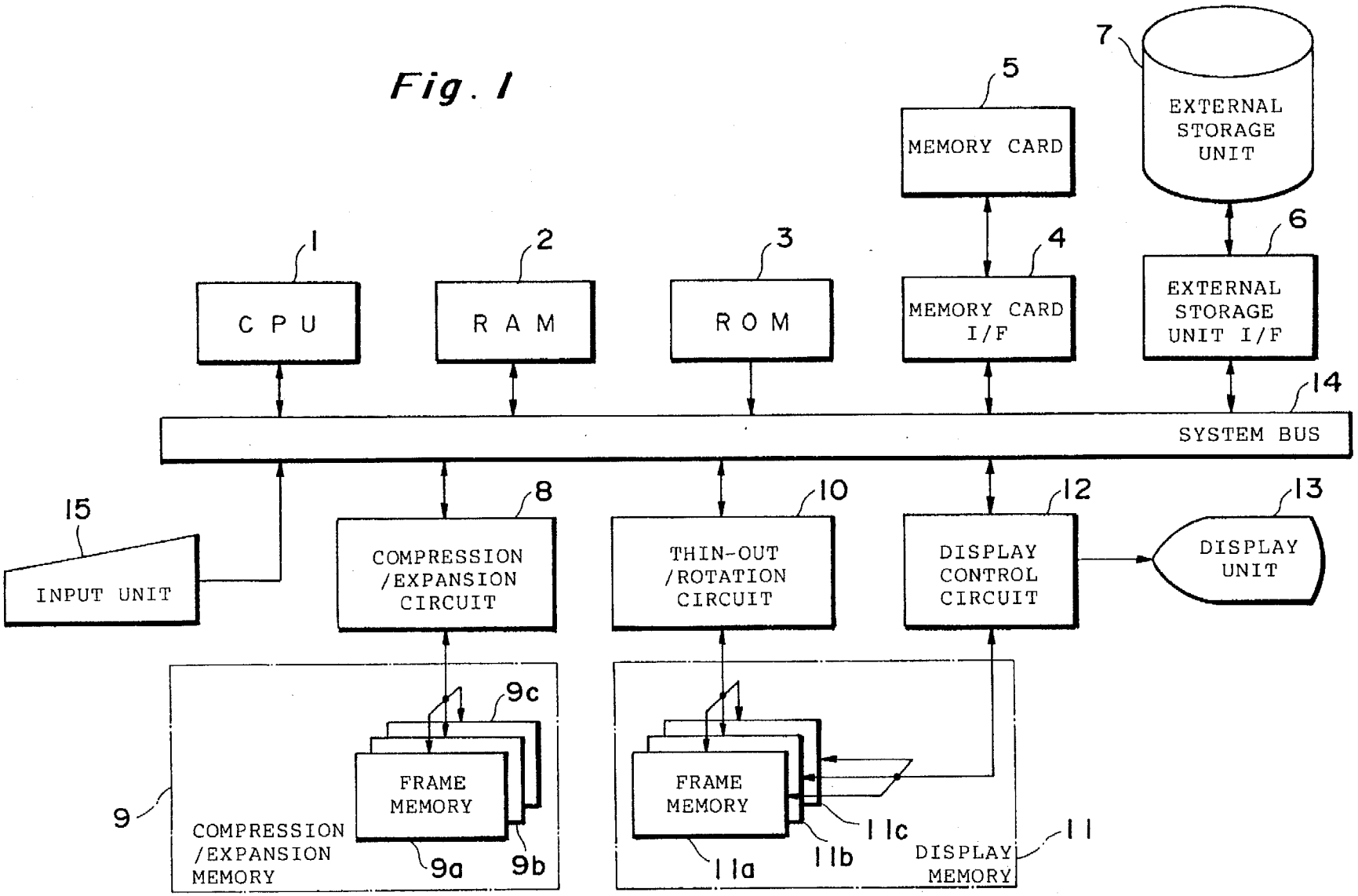
FIG. 1 is a block diagram illustrating the configuration of an image display apparatus.

FIG. 1 is a block diagram showing the electrical configuration of an image display apparatus according to the present invention.

Under the control of a display control circuit 12, a display unit (CRT display unit, liquid-crystal display unit, etc.) 13 displays image data, which has been stored in a display memory (RAM, etc.) 11, on a display screen. The display unit 13, display control circuit 12 and display memory 11 construct a bitmap display apparatus.

The display memory 11 is equipped with three frame memories 11*a*, 11*b* and 11*c*. The frame memory 11*a* stores R image data of R, G, B image data. The frame memories 11*b* and 11*c* store the G and B image data, respectively. Each item of the stored R, G, B image data is bitmap image data.

Figure 4:
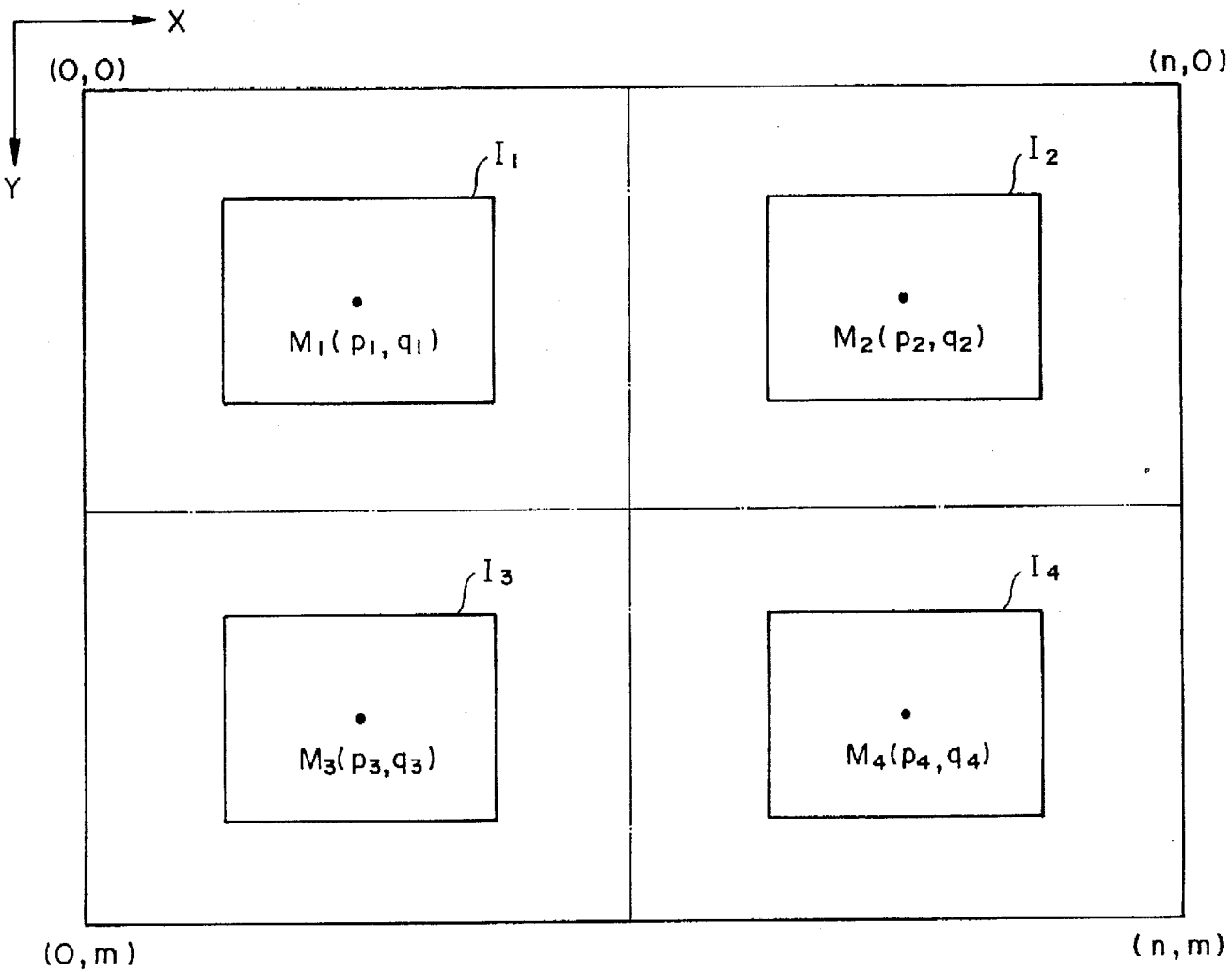
FIG. 4 illustrates display positions of each of four frames of images on a display screen where four frames of images are displayed.

The display screen of the display unit 13 has n×m (e.g., 640×480) pixels, as shown in FIG. 4. Coordinates are assigned to each pixel, and the upper left-hand corner of the screen serves as the origin (0,0). The horizontal direction from left to right is as the X axis, and the vertical direction from top to bottom is the Y axis. The memory cell at the starting address of the frame memory 11*a* corresponds to the pixel at the origin. The memory cells at addresses following the starting address correspond to the pixels along the raster direction in regular order. The same is true for the frame memories 11*b* and 11*c*. Accordingly, three memory cells having identical (relative) addresses in the frame memories 11*a*–11*c* correspond to one pixel of the display screen. As a result, a color which is a combination of the three primary colors R, G, B can be displayed for each pixel of the display screen. The capacity of each memory cell may be one bit or a plurality of bits (four bits, eight bits, etc.) representing tones.

Compressed image data, which is obtained by compressing image data obtained by image sensing, is stored as an image file in one or both of a memory card 5 and external storage unit 7 (magnetic disk storage device, optical disk storage device, etc.). A plurality of image files are stored in these memories. One image file contains one frame of compressed image data. A file name specifying each image file is stored in a directory of the card memory 5 and external storage unit 7. Though the details will be described later, the user specifies an image file by its file name.

Figure 2:
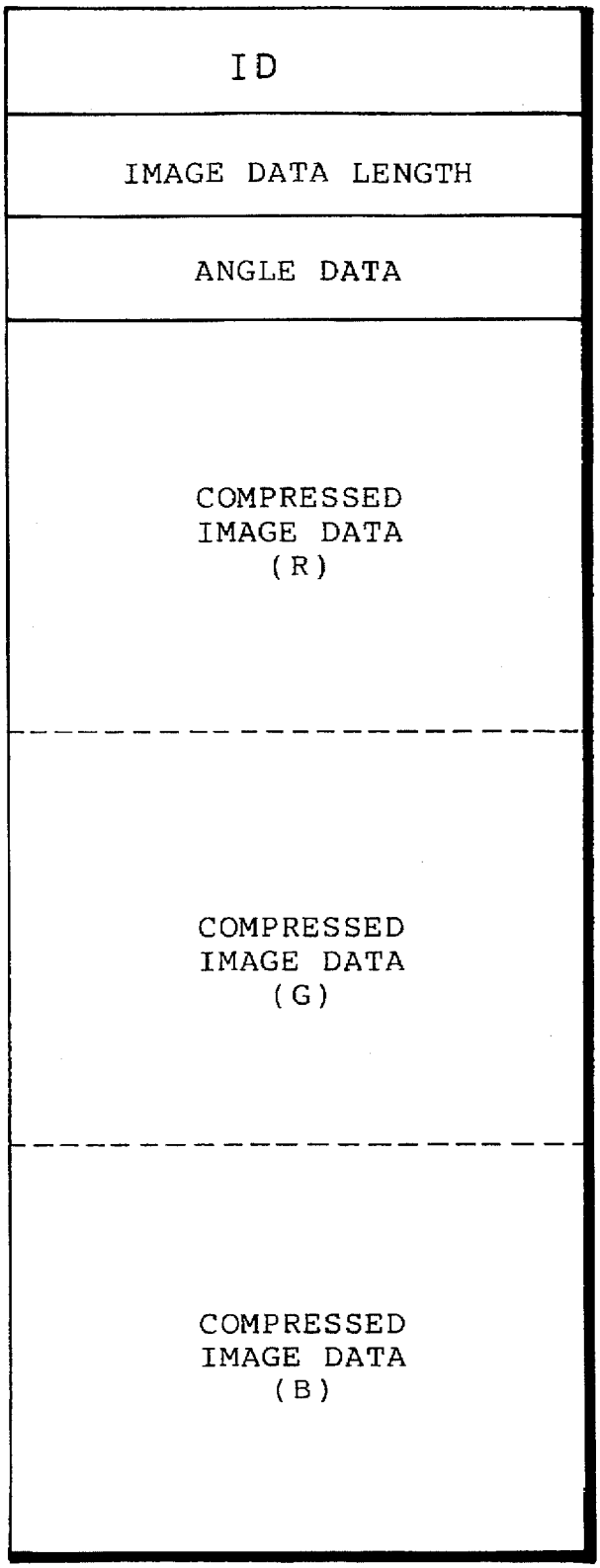
FIG. 2 shows the data structure of an image file.

FIG. 2 illustrates the data structure of an image file. An area which stores an ID (identifier) for identifying the image file is provided at the beginning of the data in the image file. Image data length is data representing the total length (number of bytes) of the compressed image data of the three colors R, G, B. Angle data is data representing the angle of inclination of the image sensing device (electronic still-video camera, etc.) prevailing at the time an image is sensed. The angle of inclination is the angle the horizontal scanning direction of the image sensing device forms with the horizontal. In the values of the angle data, the counter-clockwise direction on the display screen is taken as being positive when an image is rotated on the display screen. This will be described later in greater detail.

Figure 9A:
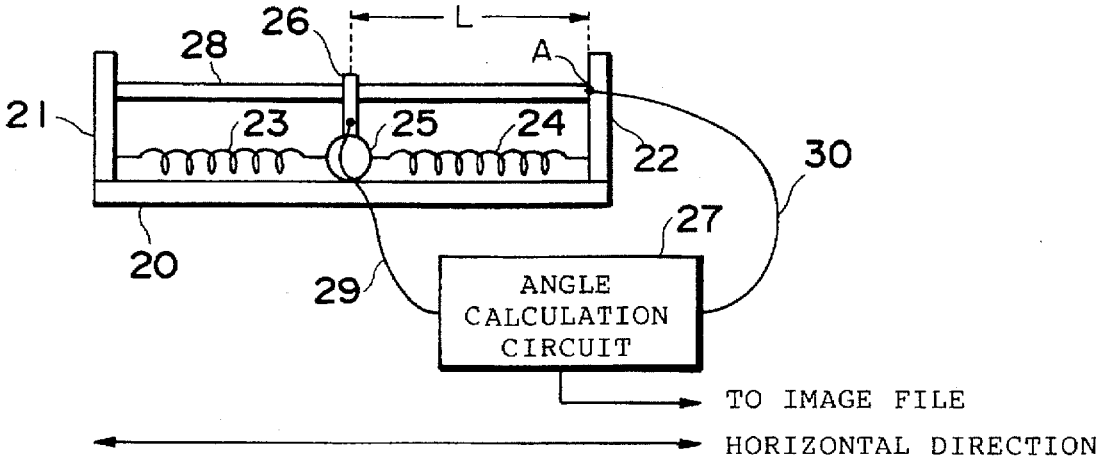
FIG. 9*a* is a front view showing an example of an angle measuring device, FIG. 9*b* a plan view of the same and FIG. 9*c* the manner in which the angle measuring device is inclined at an angle θ with respect to the horizontal.
Figure 9B:
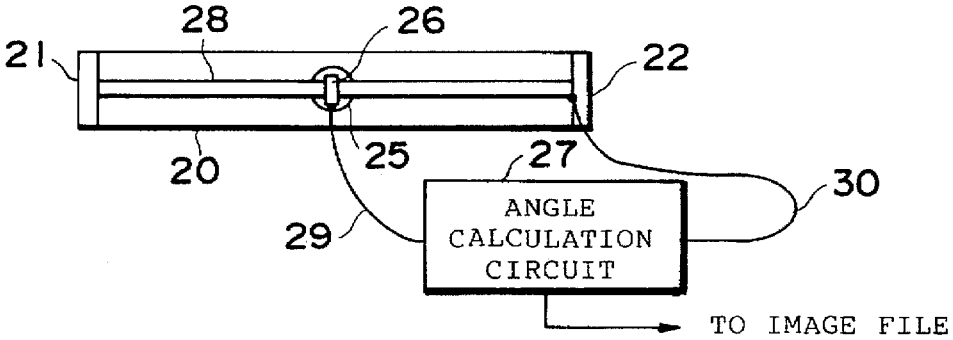

The image sensing device internally incorporates an angle measuring unit. FIGS. 9*a* and 9*b* are a front view and plan view, respectively, showing an example of the angle measuring unit.

An insulating substrate 20, insulating plates 21, 22 and an insulating weight 25 consist of insulating members through which electricity will not pass. The insulating substrate 20 is secured to the interior of the image sensing device so as to be parallel to the horizontal scanning direction of the image sensing device. The insulating plates 21 and 22 are secured to the insulating substrate 20 perpendicularly on respective sides thereof. One end of a spring 23 is attached to the insulating plate 21, and one end of a spring 24 is attached to the insulating plate 22. Both ends of a rod-shape resistor 28, which is provided in parallel with the insulating substrate 20 in spaced relation thereto, are secured to respective ones of the insulating plates 21 and 22.

The insulating weight 25 placed upon the substrate 20 is connected to the other ends of the springs 23 and 24 and is retained by the springs. When the substrate 20 is maintained in a state in which it is parallel to the horizontal, i.e., when the horizontal scanning direction of the image sensing device is maintained in a state in which it is parallel to the horizontal, the insulating weight 25 is held at a position (centrally located) midway between the insulating plates 21 and 22.

An electrically conductive terminal 26 is attached to the insulating weight 25. The rod-shaped resistor 28 passes through the conductive terminal 26 in a freely slidable manner and is electrically connected to the terminal 26. As the insulating weight 25 moves to the right or left, the conductive terminal 26 moves freely to the right or left while remaining electrically connected to the rod-shaped resistor 28. One end A of the rod-shaped resistor 28 and the conductive terminal 26 (let L represent the distance between them) are electrically connected to an angle calculating circuit 27 by conductive cords 30 and 29, respectively.

Figure 9C:
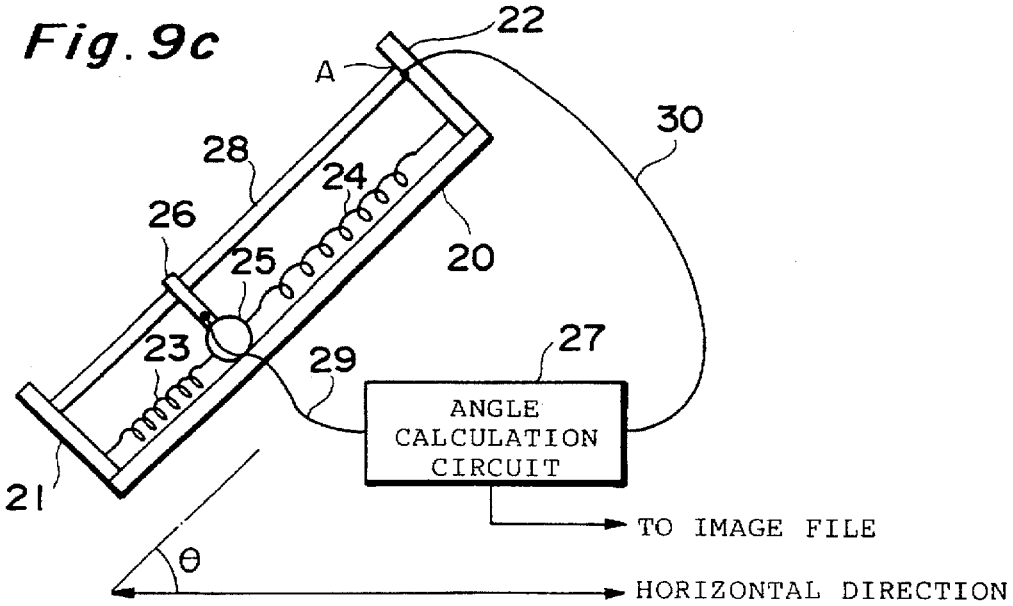

When the horizontal scanning direction of the image sensing device is inclined with respect to the horizontal, the insulating substrate 20 and rod-shaped resistor 28 are also inclined with respect to the horizontal, as shown in FIG. 9*c*. As a result, the insulating weight 25 and the conductive terminal 26 move leftward (or rightward) from the central position. As a result, the value of length L changes and so does the resistance value between the conductive terminal 26 and the end A of the rod-shaped resistor 28. The angle calculating circuit 27 determines the angle of inclination on the basis of this resistance value. The inclination angle obtained is written in an image file as angle data. By way of example, the angle data is 0° when the horizontal scanning direction of the image sensing device is made horizontal and 90° (leftward movement of the insulating weight) or −90° (rightward movement of the insulating weight) when the horizontal scanning direction is made vertical to the horizontal.

It goes without saying that other types of angle measuring units may be adopted. For example, one of the known angle measuring units is that which comprises a weight, an arm supporting the weight at its one end, and a sensor sensing tension acting on the arm, the tension changing in dependence upon the angular position of the unit.

With reference again to FIG. 2, the three items of compressed image data of the colors R, G, B have identical lengths (numbers of bytes). Accordingly, the length (number of bytes) of each item of compressed R, G, B image data can be determined by dividing the above-mentioned image data length by three. Each item of compressed R, G, B image data is the result of compressing bitmap image data. By decompressing (expanding) each item of compressed R, G, B image data, image data, which is constructed from n×m items of pixel data, corresponding to each pixel of the display unit 13 is obtained. In each item of decompressed R, G, B image data, the pixel data at the beginning is displayed at the pixel of the origin [coordinates (0,0)] on the display unit 13. Pixel data following the pixel data at the beginning is displayed in order at pixels along the raster direction of the display unit 13 starting from the origin.

In FIG. 1, a memory card I/F (interface) 4 performs processing for interfacing the memory card 5 and a system bus 14. An external storage I/F (interface) 6 performs processing for interfacing the external storage unit 7 and the system bus 14.

A compression/expansion circuit 8 compresses and decompresses image data provided by the memory card 5 or external storage unit 7. A compression/expansion memory 9 has three frame memories 9*a*, 9*b* and 9*c*. The frame memory 9*a* stores R image data (from among the R, G, B data) compressed or decompressed by the compression/expansion circuit 8. Similarly, the frame memory 9*b* stores compressed or decompressed G image data, and the frame memory 9*c* stores compressed or decompressed B image data. The frame memories 9*a*–9*c* each have enough storage capacity to store image data obtained by decompressing respective ones of the items of compressed R, G, B data contained in the image file. (Image data obtained by decompressing compressed image data shall be referred to as "original image data".)

A thin-out/rotation circuit 10 executes processing to thin out and rotate image data. FIG. 3 illustrates the manner in which original image data is thinned out. The left side of FIG. 3 shows any single item of three items of original image data in R, G, B. As mentioned above, the original image data is composed of plural items of pixel data each displayed at a pixel on the display unit 13. Coordinates along the raster direction correspond to the original image data in order starting from the pixel data at the beginning. Coordinates are written for the sake of convenience to facilitate an understanding of the description; these coordinates are not contained in the original image data.

The right side of FIG. 3 shows image data after being thinned out. (This data shall be referred to as "reduced image data" or "thinned-out image data".) Coordinates along the raster direction starting from the origin are also assigned in order to the items of pixel data constructing the reduced image data. Coordinates are written for the sake of convenience to facilitate an understanding of the description; these coordinates are not contained in the reduced image data.

Here original image data comprising 640×480 items of pixel data is thinned out so as to become reduced image data comprising 160×120 items of pixel data (representing reduction by a factor of ¼ vertically and horizontally). Pixel data at coordinates which are the result of dividing both the values of the x coordinates and the values of the y coordinates by four remains. (This is referred to as a thin-out rate of 4). Pixel data other than this pixel data is thinned out. This processing is applied to each item of the original R, G, B image data.

The reduced image data for R among R, G, B is stored in the frame memory 11*a*. Similarly, the reduced image data for B is stored in the frame memory 11*b* and the reduced image data for G is stored in the frame memory 11*c*.

In a case where the pixel data in each of the vertical and horizontal directions is reduced by a factor of ½, pixel data at coordinates which are the result of dividing both the values of the x coordinates and the values of the y coordinates by two remains; pixel data other than this pixel data is thinned out. (This is referred to as a thin-out rate of 2). Thinning out is performed in the same manner when reduction is performed at other magnifications as well.

A value of thin-out rate is predetermined in conformity with the number of frames of images (referred to hereinafter as the "displayed frame count") displayed on the display unit 13. (It will be described later that the displayed frame count is designated by the user.) The thin-out rate and the displayed frame count are stored beforehand in a ROM 3 in correlated form. For example, in a case where four frames of images are displayed on the display unit 13, the corresponding thin-out rate of value 4 is stored in the ROM 3.

Next, each item of reduced R, G, B image data is read out of a respective one of the frame memories 11*a*–11*c*. Each item of reduced R, G, B image data read out is subjected to movement (parallel transition) processing for movement to a position (referred to as the "display position") at which the data is to be displayed on the display screen, and to rotation processing based upon the angle data. If the value of the angle data is 0°, then rotation processing is not executed.

The display position is predetermined in conformity with the displayed frame count. FIG. 4 illustrates the display position of each image in a case where four frames of images $I_1$~$I_4$ are displayed on the display screen. Coordinates $M_1$ $(P_1,q_1)$–$M_4$ $(P_4,q_4)$ (hereinafter referred to as "offset coordinates") corresponding to the centers of the image display areas of the respective images $I_1$~$I_4$ are stored beforehand, as coordinates representing the display positions, in the ROM 3 in correlation with the displayed frame count 4. In a case where the display screen is composed of n×m pixels, generally the coordinates are made as follows: $p_1=p_3=n/4$; $p_2=p_4=3\cdot(n/4)$; $q_1=q_2=m/4$; $q_3=q_4=3\cdot(m/4)$.

In a case where the reduced image data is composed of pixel data of a×b pixels from the origin (0,0) to the coordinates (a1,b-1), movement processing is executed on the basis of the equations given below. Let $(x_0,y_0)$ represent the coordinates of each item of pixel data constituting the reduced image data before movement processing, and let $(x_1,y_1)$ represent the coordinates of each item of pixel data constituting the reduced image data after movement processing based upon the offset coordinates $(p_i,q_i)$ (i=1~4).

$$x_1=x_0-a/2+p_i \quad (1)$$

$$y_1=y_0-b/2+q_i \quad (2)$$

In a case where the value of one or both of a/2 and b/2 is a fraction, one of the operations of rounding to the nearest whole number, discarding fractions or raising to a unit is performed to obtain an integer value.

Movement processing is performed with regard to each item of reduced R, G, B image data of image $I_1$. The same is true with regard to images $I_2$~$I_4$. The images $I_2$~$I_4$ are moved to the positions shown in FIG. 4.

Next, rotation processing is applied to each image that has been moved. The coordinates of the center of rotation are the offset coordinates. For example, the center coordinates for rotation of the first image $I_1$ are the offset coordinate $M_1$ $(p_1,q_1)$.

Rotation processing is carried out in accordance with the equations given below. Let $(x_1,y_1)$ represent the coordinates of each item of pixel data constituting the reduced image data after movement, in the same manner as described above. Let $\theta_i$ (i=1~4) represent the angle of rotation (angle data) (where counter-clockwise rotation on the display screen is positive), and let $(x_2,y_2)$ represent the coordinates of each item of pixel data constituting the reduced image data after rotation.

$$x_2=\cos\theta_i\cdot(x_1-p_i)+\sin\theta_i\cdot(y_1-q_i)+p_i \quad (3)$$

$$y_2=\cos\theta_i\cdot(y_1-q_i)-\sin\theta_i\cdot(x_1-p_i)+q_i \quad (4)$$

In a case where the value of one or both of $x_2$ and $y_2$ is a fraction, one of the operations of rounding to the nearest whole number, discarding fractions or raising to a unit is performed so that the value of the coordinate after rotation will become an integer. In a case where two or more items of pixel data having the same coordinates exist after rotation processing, either one is selected.

Rotation processing is performed with regard to each item of reduced R, G, B image data in image $I_1$. The same is true with regard to images $I_2$~$I_4$.

Reduced image data not subjected to rotation processing because the value of the rotation angle data is 0° and reduced image data subjected to rotation processing shall be referred to as "rotated image data" below.

Each item of pixel data constituting the rotated image data is stored in the display memory 11 while being rearranged in such a manner that the coordinates assume regular order in the raster direction. The rotated image data for R among R, G, B is stored in the frame memory 11*a* while being rearranged. Similarly, the rotated image data for G is stored in the frame memory 11*b* while being rearranged, and the rotated image data for B is stored in the frame memory 11*c* while being rearranged.

Figure 5:
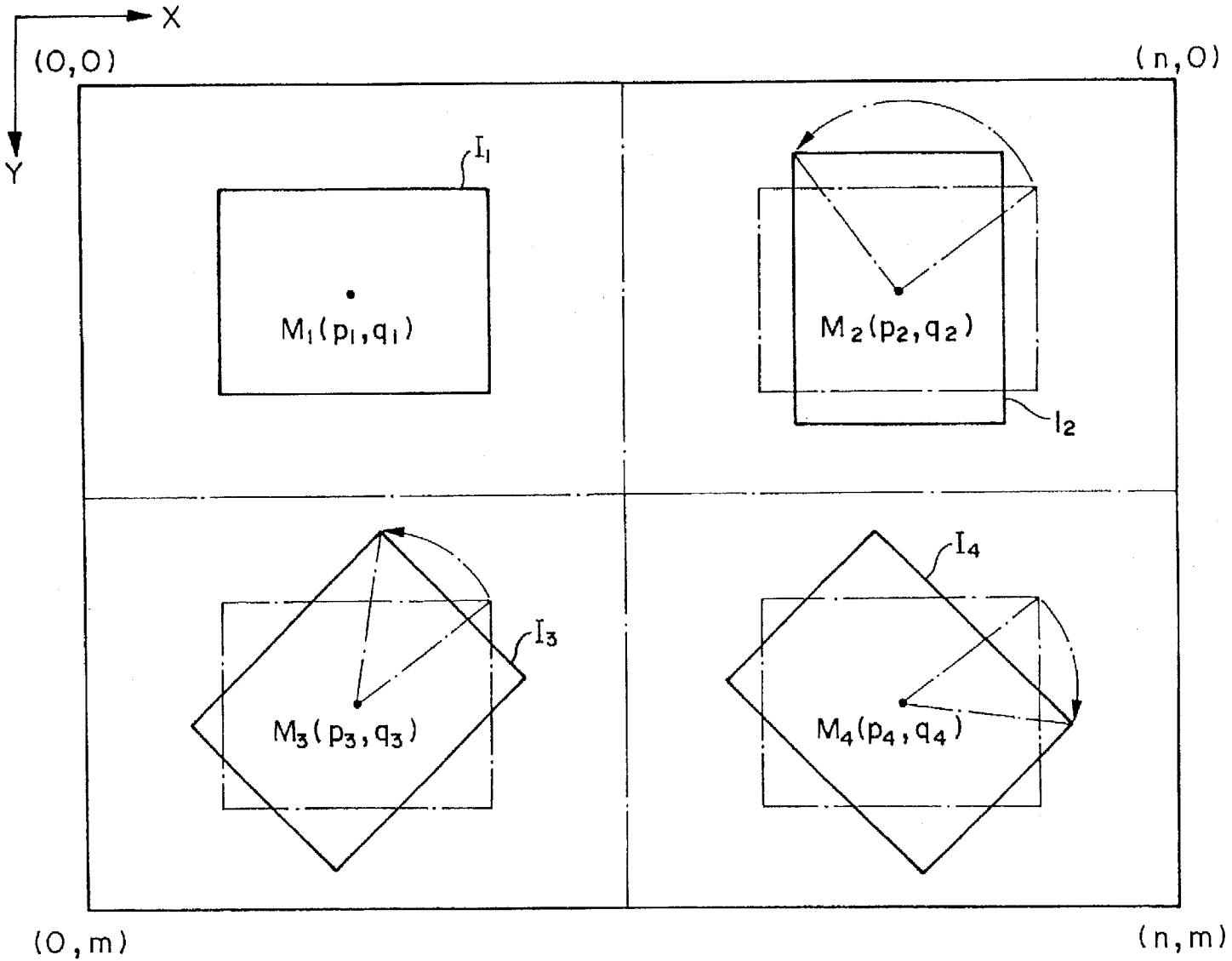
FIG. 5 illustrates an example of image rotation processing.

FIG. 5 illustrates the images $I_1$~$I_4$ after rotation processing. The image $I_1$ does not undergo rotation processing ($\theta_1$=0°). The image $I_2$ is rotated through an angle of $\theta_2$=90°, and the images $I_3$, $I_4$ are rotated through angles of $\theta_3$=45°, θ4=−45°, respectively.

It is of course possible to reverse the order to movement processing and rotation processing so that the movement processing is executed after the rotation processing.

Figure 6:
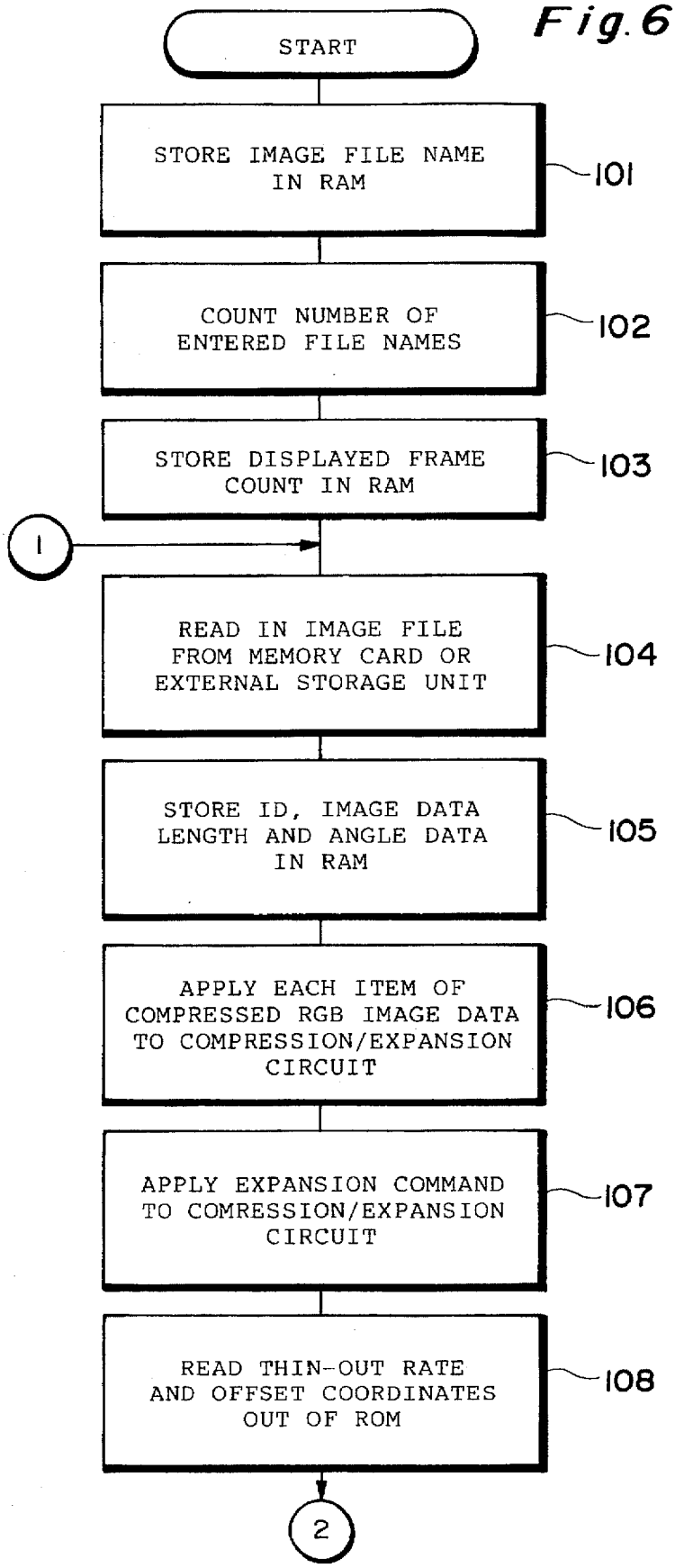
FIGS. 6 and 7 are flowcharts showing the flow of image display processing.
Figure 7:
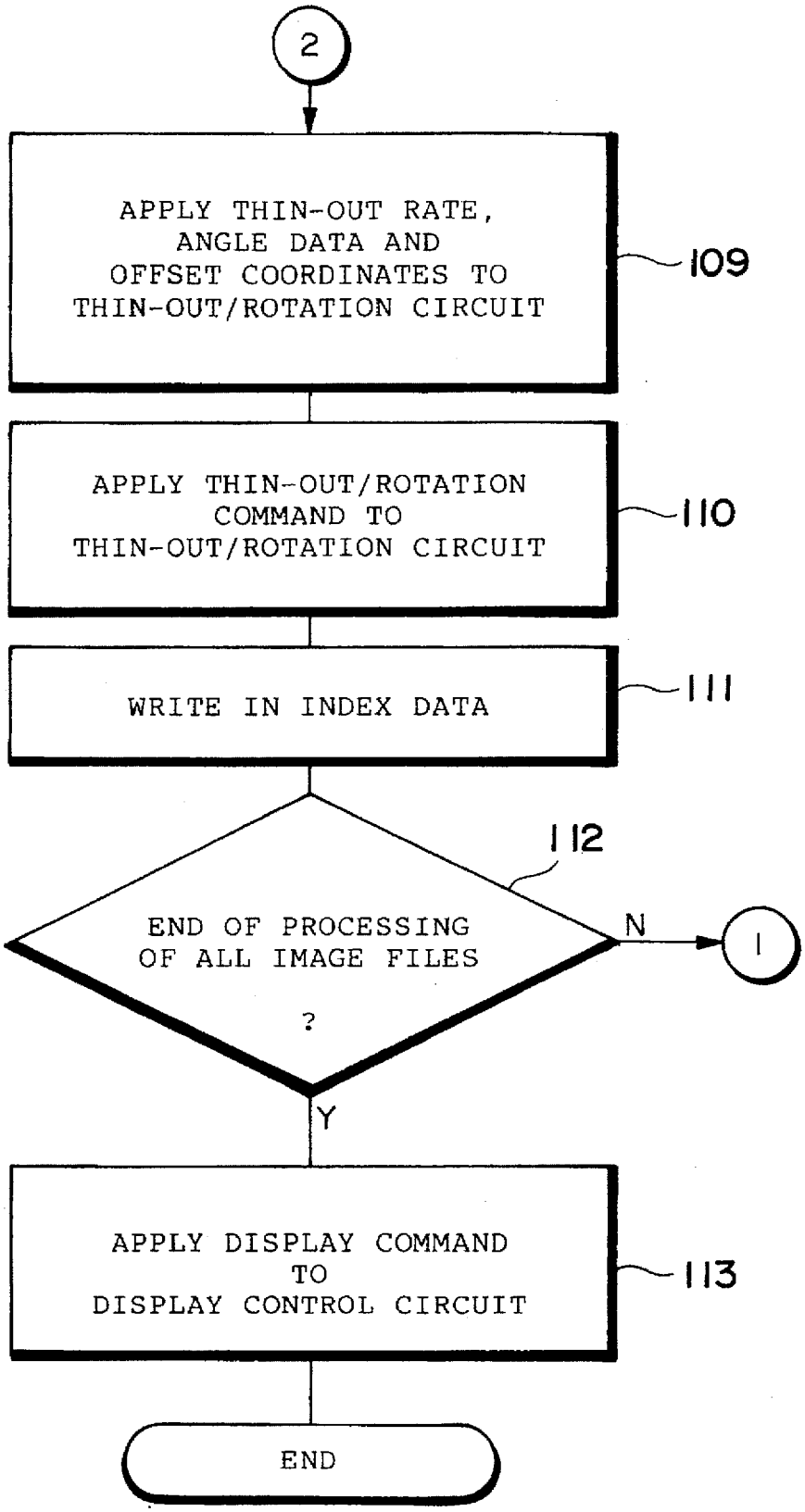

FIGS. 6 and 7 are flowcharts illustrating the flow of image display processing executed by a CPU 1. The content of processing is written in a program stored in the ROM 3 in advance.

Among the image files that have been stored in the memory card 5 or external storage unit 7, a plurality of image files to be displayed on the display unit 13 are entered by the user at an input unit 15 (keyboard, mouse, input pen, etc.). The entered file name is stored in the RAM 2 (step 101). An example of the input method is to enter the file name of the image file by a keyboard. Another method is to display the file name of an image file on the display unit 13 and enter the file name by clicking on it using a mouse. Entry is also possible by an input pen.

At entry of file names, the number of file names entered is counted by the CPU 1 (step 102). The number corresponds to the above-mentioned displayed frame count (and will be referred to as the displayed frame count below as well). The displayed frame count is stored in the RAM 2 (step 103).

The image file corresponding to the file name entered first among the plurality of file names entered is read out of the memory card 5 or external storage unit 7 by the CPU 1 (step 104). The ID, data length and angle data in the image file read out are stored in the RAM 2 (step 105).

On the basis of the image data length, the CPU 1 extracts each item of compressed R, G, B image data from the image file and applies this image data to the compression/expansion circuit 8 (step 106). Further, the CPU 1 applies an expansion processing command to the compression/expansion circuit 8 (step 107). As a result, the compression/expansion circuit 8 applies decompression processing to each item of compressed R, G, B image data and stores each item of original R, G, B image data in respective ones of the frame memories 9*a*~9*c*.

Next, the CPU 1 reads out the displayed frame count and angle data stored in the RAM 2. The CPU 1 reads the thin-out rate and offset coordinates, which correspond to the displayed frame count, out of the ROM 3 (step 108). The CPU 1 applies the thin-out rate, angle data and offset coordinates to the thin-out/rotation circuit 10 (step 109). The CPU 1 then applies a thin-out/rotation command to the thin-out rotation circuit 10 (step 110). As a result, the thin-out/rotation circuit 10 reads out the original R, G, B image data stored in the frame memories 9*a*–9*c* and subjects this data to thin-out, movement and rotation processing. The thin-out/rotation circuit 10 stores the rotated R, G, B image data in the respective frame memories 11*a*–11*c* while rearranging the data in such a manner that the coordinates are placed in regular order in the raster direction. Next, the CPU 1 writes index data in at least one of the frame memories 11*a*–11*c* via the thin-out/rotation circuit 10 (step 111). Index data is the result of converting the file name (a character or numeric string) of an image file or the aforementioned ID (a numeric or character string) contained in the image file to bitmap image data. Bitmap image data corresponding to the characters and numerals is stored in the ROM 3 in advance. Such coordinates that the index data will be displayed at the top, bottom, right or left side of image $I_i$ (the image of the image file) are selected as coordinates at which the index data is written.

Next, image files are processed one after another. That is, the image file corresponding to the file name entered second is processed, the image file corresponding to the file name entered third is processed, and so on (NO at step 112; steps 104~111).

If processing regarding all image files is finished (YES at step S112), then the CPU 1 applies a display command to the display control circuit 12 (step 113). As a result, the display control circuit 12 causes the display unit 13 to display the rotated R, G, B image data that has been stored in the display memory 11 (frame memories 11*a*, 11*b*, 11*c*). Image display processing is then terminated.

Figure 8:
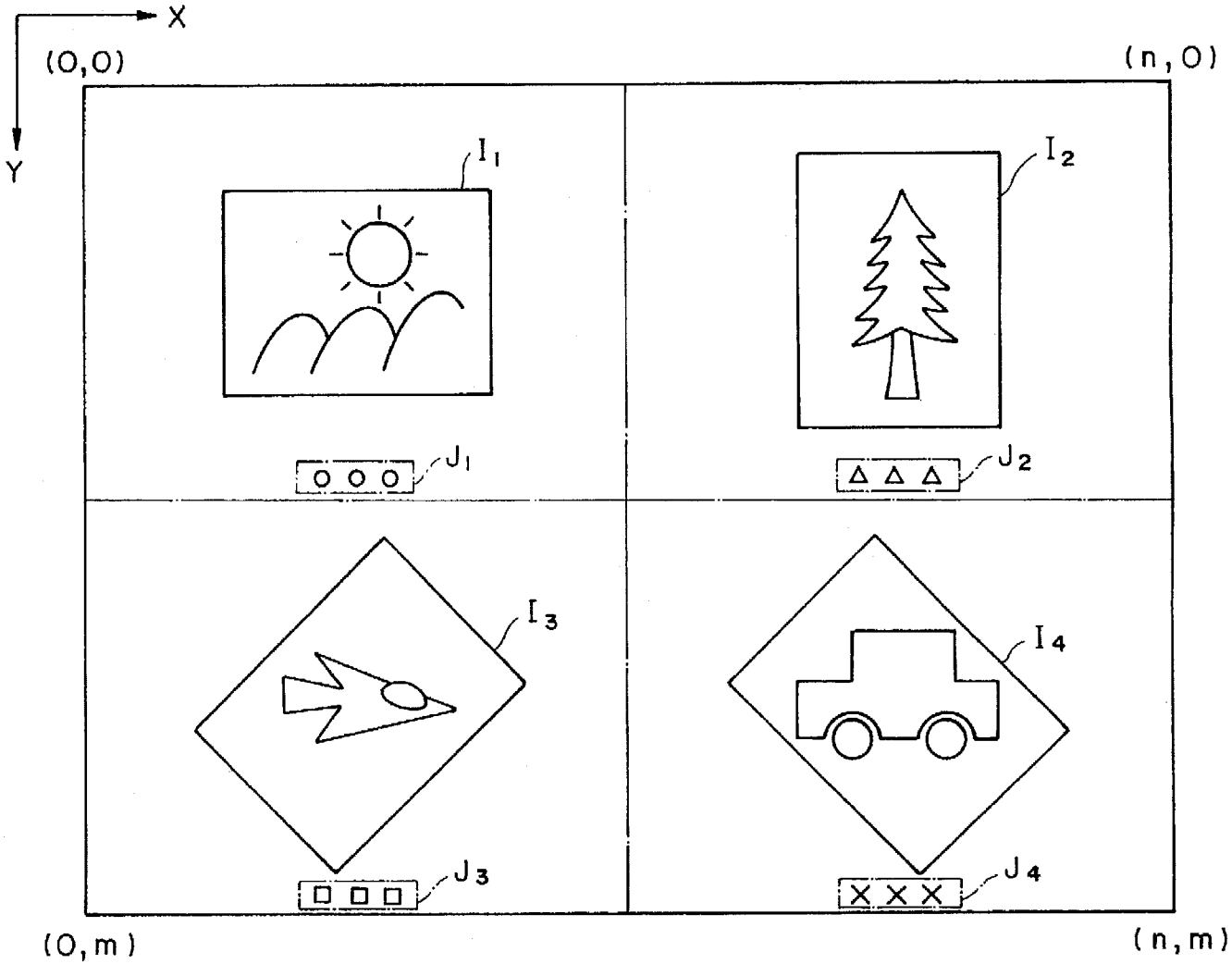
FIG. 8 illustrates an example of images displayed on the display screen of a display device.

FIG. 8 illustrates an example of images displayed on the display screen of the display unit 13. The image corresponding to the image file entered first is image $I_1$. Images corresponding to the image files entered second, third and fourth correspond to images $I_2$, $I_3$ and $I_4$, respectively. The thin-out rate is 4. Image $I_1$ has not rotated. Images $I_2$, $I_3$ and $I_4$ have been rotated by 90°, 45° and −45°, respectively. Items of index data $J_1$~$J_4$ are displayed below the images $I_1$~$I_4$, respectively.

It goes without saying that only one frame of an image may be displayed on the display unit 13 in the image display apparatus. Further, in a case where luminance image data and color image data after Y/C processing have been stored in the memory card 5 or external storage unit 7, processing similar to that described above is executed after the Y/C data is converted to R, G, B data by a circuit (not shown) for this purpose, thereby making it possible to display the image on the display unit 13.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus comprising:

a memory, storing plural items of image data, which represent images of a plurality of frames captured by an image sensing device, having an angle measuring device, in a form correlated with angle data representing obtained from the angle measuring device and an angle of inclination of the image sensing device when each image was captured;

a display device, displaying the images of the plurality of frames simultaneously on a single display screen;

an image size reduction circuit, reducing each of the plural items of image data;

a rotating circuit, rotating the plural items of image data, which have been reduced by said image size reduction circuit, based on the angle data corresponding to each image; and a display control device, performing control so as to determine a display position, in said display device, of each of the plural items of image data rotated by said rotating circuit, and to display, at respective ones of the display positions decided, the images of the plurality of frames represented by the rotated plural items of image data.

2. The apparatus according to claim 1, wherein said image size reduction circuit includes a thinning-out circuit, and said thinning-out circuit decides a thin-out rate based on a number of frames of images displayed on said display device.

3. The apparatus according to claim 1, wherein an identifier for identifying each item of image data is assigned beforehand to each of the plural items of image data; and said display control device causes said display device to display the identifier assigned to the image data representing the images corresponding to the respective displayed images of the plurality of frames.

4. An image display apparatus comprising:

memory means for storing plural items of image data, which represent images of a plurality of frames captured by an image sensing device, having an angle measuring device, in a form correlated with angle data obtained from the angle measuring device and representing an angle of inclination of the image sensing device when each image was captured;

display means for displaying the images of the plurality of frames simultaneously on a single display screen;

image size reduction means for reducing each of the plural items of image data;

rotating means for rotating the plural items of image data, which have been reduced by said image size reduction means, based on the angle data corresponding to each image; and display control means for performing control so as to determine a display position, in said display means, of each of the plural items of image data rotated by said rotating means, and to display, at respective ones of the display positions decided, the images of the plurality of frames represented by the rotated plural items of image data.

5. The apparatus according to claim 4, wherein said image size reduction means includes thinning-out means, and said thinning-out means decides a thin-out rate based on a number of frames of images displayed on said display means.

6. The apparatus according to claim 4, wherein an identifier for identifying each item of image data is assigned beforehand to each of the plural items of image data;

wherein the display control means cause said display means to display the identifier assigned to the image data representing the images the respective displayed images of the plurality of frames.

7. An image display method comprising the steps of:

storing plural items of image data, which represent images of plurality of frames captured by an image sensing device, having an angle measuring device, in a form correlated with angle data obtained from the angle measuring device representing an angle of inclination of the image sensing device when each image was captured;

reducing each of the plural items of image data;

rotating the reduced plural items of image data based on the angle data corresponding to this image data;

determining a display position, in a display unit, of each of the plural items of image data rotated; and displaying, at respective ones of the display positions determined, the images of the plurality of frames represented by the rotated plural items of image data.

8. The method according to claim 7, wherein a thin-out rate of image data is decided based on a number of frames of images displayed.

9. The method according to claim 7, further comprising the steps of:

assigning an identifier for identifying each item of image data to each of the plural items of image data in advance; and displaying the identifier, assigned to the image data representing the images, in correspondence with the respective displayed images of the plurality of frames.

* * * * *